US008311811B2

(12) United States Patent
Oh et al.

(10) Patent No.: US 8,311,811 B2
(45) Date of Patent: Nov. 13, 2012

(54) METHOD AND APPARATUS FOR DETECTING PITCH BY USING SUBHARMONIC-TO-HARMONIC RATIO

(75) Inventors: Kwang Cheol Oh, Seongnam-si (KR); Jae-Hoo Jeong, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1272 days.

(21) Appl. No.: 11/604,276

(22) Filed: Nov. 27, 2006

(65) Prior Publication Data

US 2007/0174049 A1 Jul. 26, 2007

(30) Foreign Application Priority Data

Jan. 26, 2006 (KR) ..... 10-2006-0008162

(51) Int. Cl.
*G10L 11/04* (2006.01)

(52) U.S. Cl. ..... 704/207; 704/205; 704/206; 704/208; 704/258; 704/231

(58) Field of Classification Search ..... 704/207, 704/217, 214, 211, 208, 236, 228; 455/403
See application file for complete search history.

(56) References Cited

U.S. PATENT DOCUMENTS 5,809,455 A * 9/1998 Nishiguchi et al. ..... 704/214
5,890,108 A * 3/1999 Yeldener ..... 704/208
6,691,085 B1 * 2/2004 Rotola-Pukkila et al. .... 704/228
6,829,578 B1 * 12/2004 Huang et al. ..... 704/211
2002/0016161 A1 * 2/2002 Dellien et al. ..... 455/403
2003/0088401 A1 * 5/2003 Terez ..... 704/207
2003/0187635 A1 * 10/2003 Ramabadran et al. ..... 704/217
2004/0128130 A1 * 7/2004 Rose et al. ..... 704/236

OTHER PUBLICATIONS

Xuejing Sun, "Pitch Determination and Voice Quality Analysis Using Subharmonic-To-Harmonic Ratio", May 17, 2002, IEEE, pp. 333-336.*

L. R. Rabiner et al., "Digital Processing of Speech Signals", 1978 (Bell Laboratories, Incorporated), Prentice-Hall, Inc., p. 156.*

* cited by examiner

*Primary Examiner* — Michael N Opsasnick
*Assistant Examiner* — Mark Villena
(74) *Attorney, Agent, or Firm* — Staas & Halsey LLP

(57) ABSTRACT

A method and an apparatus for detecting a pitch in input voice signals by using a subharmonic-to-harmonic ratio (SHR). The pitch detection method includes performing a Fourier transform on the input voice signals after performing a pre-processing on the input voice signals, performing an interpolation on the transformed voice signals, calculating a normalized local center of gravity (NLCG) on a spectrum of the interpolated voice signals, calculating a cumulated sum of the calculated NLCG, calculating an SHR from the spectrum based on the calculated cumulated sum, and extracting the pitch based on the calculated SHR.

13 Claims, 4 Drawing Sheets

METHOD AND APPARATUS FOR DETECTING PITCH BY USING SUBHARMONIC-TO-HARMONIC RATIO

CROSS-REFERENCE TO RELATED APPLICATION

This application claims priority from Korean Patent Application No. 10-2006-0008162, filed on Jan. 26, 2006, in the Korean Intellectual Property Office, the disclosure of which is incorporated herein by reference.

BACKGROUND OF THE INVENTION

1. Field of the Invention

The present invention relates to a method and an apparatus for detecting pitch in input voice signals by using subharmonic-to-harmonic ratio.

2. Description of Related Art

In the field of voice signal processing such as speech recognition, voice synthesis, and analysis, it is important to exactly extract the basic frequency, i.e. the pitch cycle. The exact extraction of the basic frequency may not only enhance recognition accuracy through reduced speaker-dependent speech recognition, but easily alter or maintain naturalness and personality in voice synthesis. Additionally, voice analysis synchronized with a pitch may allow for obtaining a correct vocal track parameter from which effects of glottis are removed.

For the above reasons, a variety of ways of implementing a pitch detection in a voice signal have been proposed in the art. Such conventional proposals may be divided into a time domain detection method, a frequency domain detection method, and a time-frequency hybrid domain detection method.

The time domain detection method, such as parallel processing, average magnitude difference function (AMDF), and auto-correlation method (ACM), is a technique to extract a pitch by decision logic after emphasizing periodicity of a waveform. Being performed mostly in a time domain, this method may require only a simple operation such as addition, subtraction, and comparison logic without requiring a domain conversion. However, when a phoneme ranges over a transition region, pitch detection may be difficult due to excessive variations of a level in a frame and fluctuations in a pitch cycle, and also may be much influenced by formant. Especially, in the case of a noise-mixed voice, a complicated decision logic for the pitch detection may increase unfavorable errors in extraction.

The frequency domain detection method is a technique to extract a basic frequency of voicing by measuring a harmonics interval in a speech spectrum. A harmonics analysis technique, a lifter technique, a comb-filtering technique, etc., have been proposed as such methods. Generally, spectrum is obtained according to a frame unit. So, even if a transition or variation of a phoneme or a background noise appears, this method may be not much affected since it may average out. However, calculations may become complicated because a conversion to a frequency domain is required for processing. Also, if pointers of a Fast Fourier Transform (FFT) increase in number to raise the precision of the basic frequency, a calculation time required is increased while being insensitive to variation characteristics.

The time-frequency hybrid domain detection method combines the merits of the aforementioned methods, that is, a short calculation time and high precision of the pitch in the time domain detection method and the ability to exactly extract pitch despite a background noise or a phoneme variation in the frequency domain detection method. This hybrid method, for example, includes a cepstrum technique and a spectrum comparison technique, may invite errors while performed between time and frequency domains, thus unfavorably influencing pitch extraction. Also, a double use of the time and frequency domains may create a complicated calculation process.

BRIEF SUMMARY

An aspect of the present invention provides a pitch detection method and an apparatus utilizing the method, which may create a robust spectrum by using a normalized local center of gravity (NLCG) on a spectrum and its cumulated sum, and then may extract a pitch from input voice signals by using a subharmonic-to-harmonic ratio (SHR) obtained from the created spectrum.

An aspect of the present invention also provides a pitch detection method and an apparatus utilizing the method, which may separate voiced and unvoiced sounds by obtaining a spectral auto-correlation by using an NLCG and interpolation of a spectrum, and then may use the separation of voiced/unvoiced sounds when extracting a pitch by using an SHR.

According to an aspect of the present invention, there is provided a pitch detection apparatus including a pre-processing unit performing a predetermined pre-processing on the input voice signals, a Fourier transform unit performing a Fourier transform on the pre-processed voice signals, an interpolation unit performing an interpolation on the transformed voice signals, a normalized local center of gravity (NLCG) unit calculating an NLCG on a spectrum of the interpolated voice signals, a cumulated sum calculation unit calculating a cumulated sum of the calculated NLCG, a subharmonic-to-harmonic ratio (SHR) calculation unit calculating an SHR from the spectrum based on the calculated cumulated sum, and a pitch extraction unit extracting a pitch by being based on the calculated SHR.

The apparatus may further comprise a spectral auto-correlation calculation unit calculating a spectral auto-correlation by using the calculated NLCG, and a voicing region determination unit determining a voicing region based on the calculated spectral auto-correlation. Here, the pitch extraction unit may extract the pitch based on the SHR corresponding to the voicing region.

According to another aspect of the present invention, there is provided a method of detecting a pitch in input voice signals, the method including performing a Fourier transform on the input voice signals after performing a pre-processing on the input voice signals, performing an interpolation on the transformed voice signals, calculating a normalized local center of gravity (NLCG) on a spectrum of the interpolated voice signals, calculating a cumulated sum of the calculated NLCG, calculating a subharmonic-to-harmonic ratio (SHR) from the spectrum based on the calculated cumulated sum, and extracting a pitch based on the calculated SHR.

According to another aspect of the present invention, there is provided a method of detecting a pitch in input voice signals, the method including: Fourier transforming the input voice signals after the input voice signals are pre-processed; interpolating the transformed voice signals; calculating a normalized local center of gravity (NLCG) on a spectrum of the interpolated voice signals; calculating a sum of the calculated NLCG; calculating a subharmonic-to-harmonic ratio (SHR) from the spectrum based on the calculated cumulated sum; and extracting a pitch based on the calculated SHR.

According to other aspects of the present invention there are provided computer-readable storage media storing programs to implement the aforementioned methods.

Additional and/or other aspects and advantages of the present invention will be set forth in part in the description which follows and, in part, will be obvious from the description, or may be learned by practice of the invention.

BRIEF DESCRIPTION OF THE DRAWINGS

The above and/or other aspects and advantages of the present invention will become apparent and more readily appreciated from the following detailed description, taken in conjunction with the accompanying drawings of which.

DETAILED DESCRIPTION OF EMBODIMENTS

Figure 1:
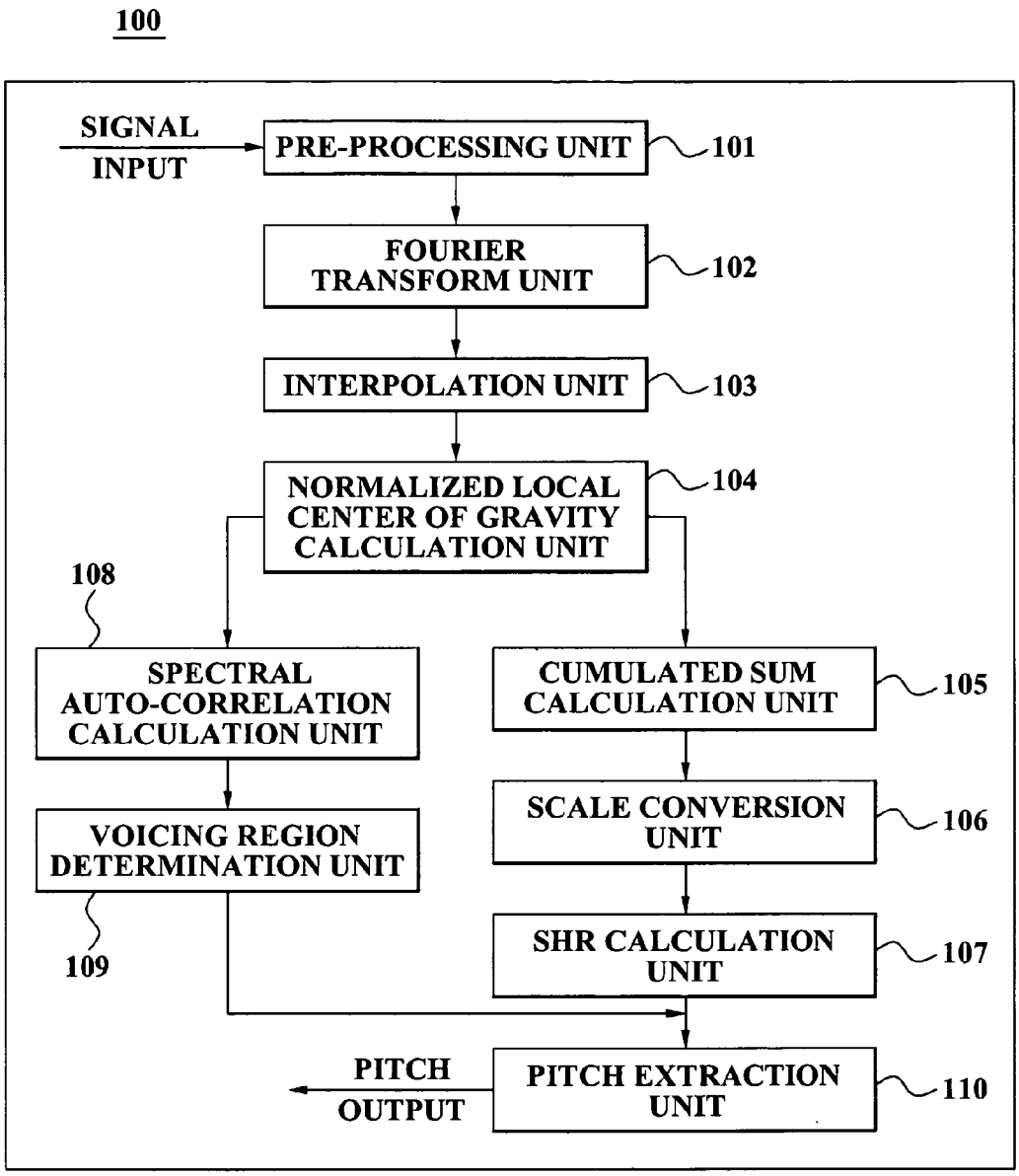
FIG. 1 illustrates a pitch detection apparatus according to an exemplary embodiment of the present invention.

Reference will now be made in detail to embodiments of the present invention, examples of which are illustrated in the accompanying drawings, wherein like reference numerals refer to the like elements throughout. The embodiments are described below in order to explain the present invention by referring to the figures.

FIG. 1 illustrates a pitch detection apparatus according to an exemplary embodiment of the present invention.

As shown in FIG. 1, the pitch detection apparatus 100 includes a pre-processing unit 101, a Fourier transform unit 102, an interpolation unit 103, a normalized local center of gravity calculation unit 104, a cumulated sum calculation unit 105, a scale conversion unit 106, a subharmonic-to-harmonic ratio calculation unit 107, a spectral auto-correlation calculation unit 108, a voicing region determination unit 109, and a pitch extraction unit 110.

By way of review of the conventional art, a typical method for detecting a pitch by using subharmonic-to-harmonic ratio (SHR) determines the pitch from a harmonic component and does not employ unnecessary information. Therefore, this method can effectively cope with halving and doubling issues of a pitch, and may be relatively resilient against a noise. This method, however, may be weak against a low pitch, such as in a man's voice, and is influenced by a spectral tilt due to a narrow interval between harmonic components in a spectrum.

To solve the above problems, the pitch detection apparatus 100 creates a robust spectrum by using a normalized local center of gravity (NLCG) on the spectrum and its cumulated sum, and then extracts a pitch from input voice signals by using an SHR obtained from the created spectrum.

Moreover, the pitch detection apparatus 100 detects the pitch in the input voice signals by using an NLCG, creating a waveform that appears in a similar shape with the waveform in a time domain. Also, a periodic structure of harmonics may be effectively preserved. A graph of a spectral auto-correlation calculated by using an NLCG represents peaks corresponding to pitch frequencies.

Figure 2:
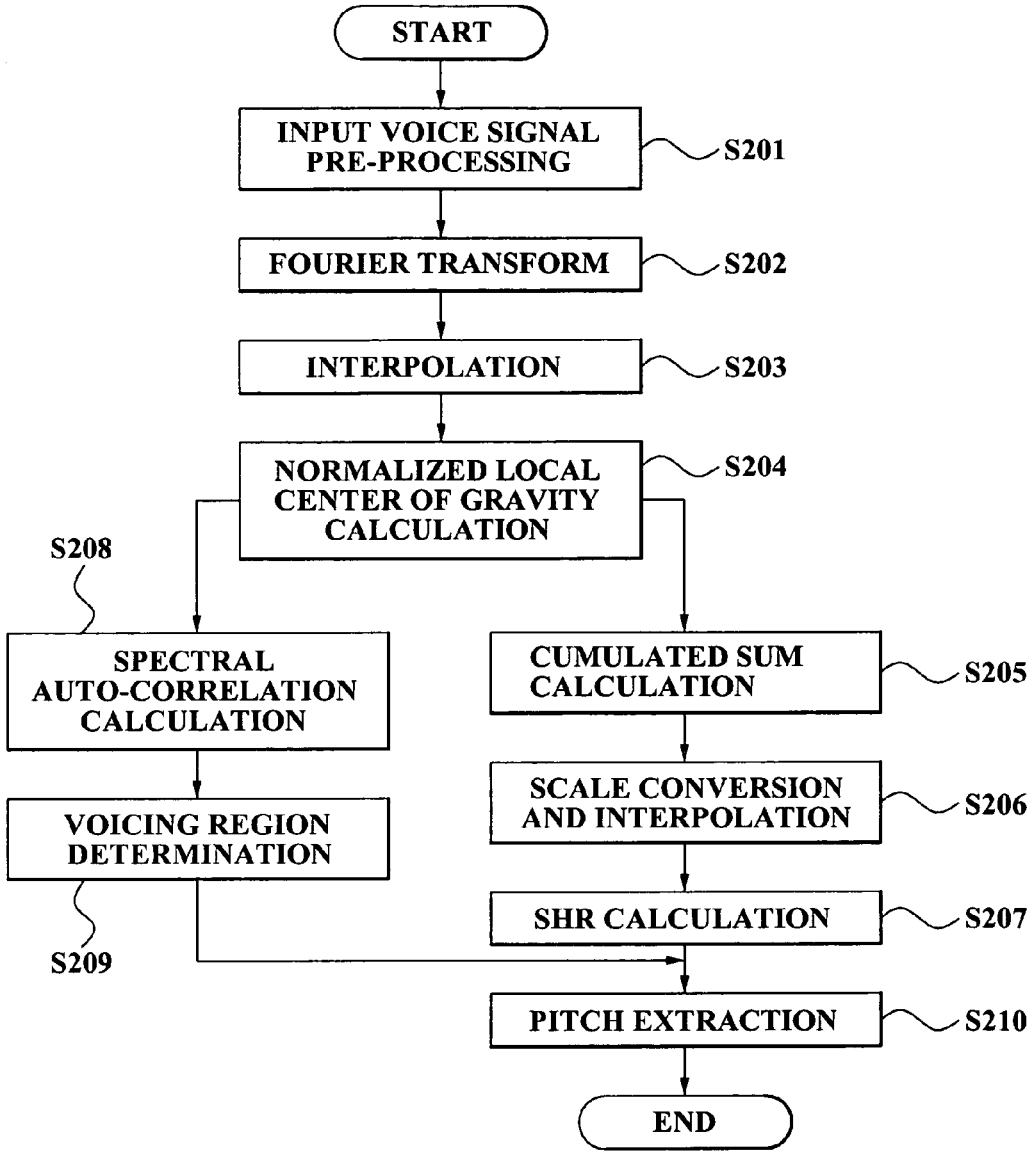
FIG. 2 illustrates a pitch detection method utilizing, for example, the apparatus of FIG. 1.
Figure 3A:
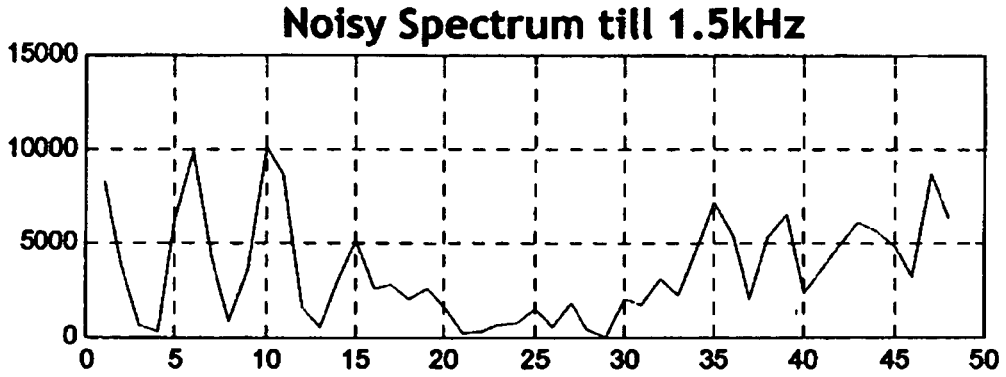
FIGS. 3A-3D illustrate a waveform of an original spectrum, a waveform of an interpolated spectrum, a waveform calculated by a normalized local center of gravity (NLCG), and a waveform calculated by a cumulated sum of the NLCG.
Figure 3B:
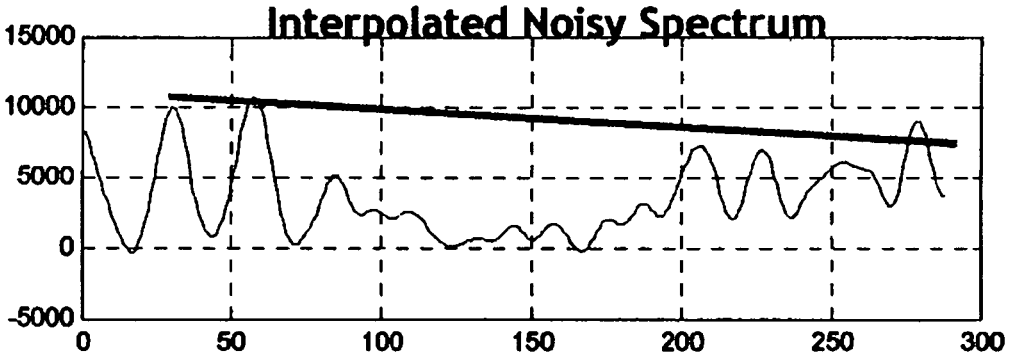
Figure 3C:
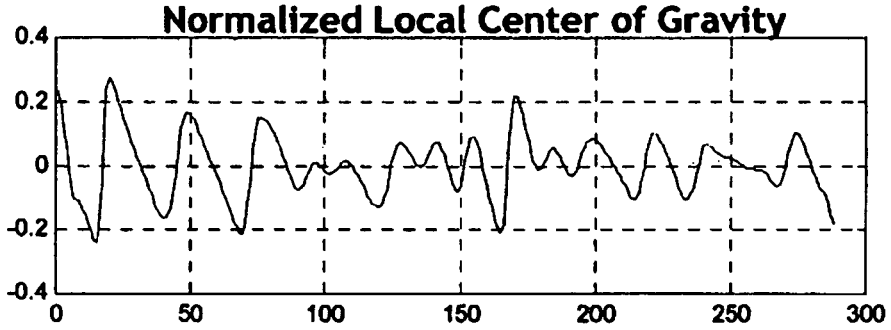
Figure 3D:
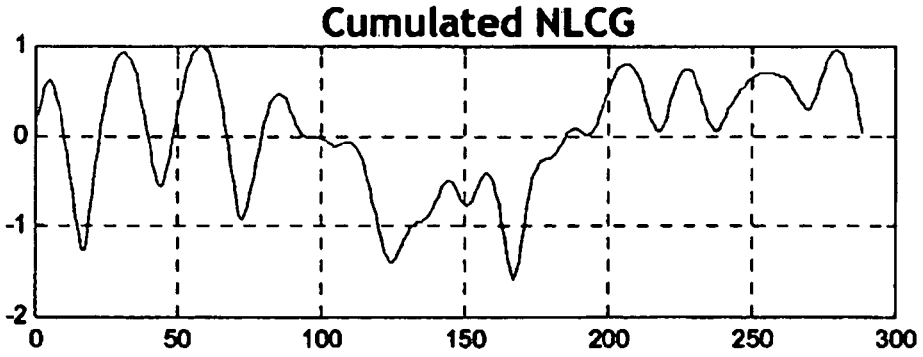

FIG. 2 illustrates a pitch detection method utilizing, by way of a non-limiting example, the apparatus of FIG. 1.

Referring to FIGS. 1 and 2, in an initial operation S201, the pre-processing unit 101 performs a predetermined pre-processing on input voice signals. In a next operation S202, the Fourier transform unit 102 performs a Fourier transform on the pre-processed voice signals as shown in Equation 1.

$$A(f) = A(e^{j2\pi k/N}) = \sum_{n=0}^{N-1} s(n)e^{j2\pi k/N} \quad \text{[Equation 1]}$$

In a next operation S203, the interpolation unit 103 performs an interpolation on the transformed voice signals as shown in Equation 2.

$$A(f_k) \Rightarrow A(f_i) \quad \text{[Equation 2]}$$

$$\text{Here, } k = 1, 2, \ldots, L_k,\ i = 1, 2, \ldots, L_i,$$

$$\text{and } R = L_i / L_k$$

In this operation S203, the interpolation unit 103 performs a low-pass interpolation with regard to amplitudes corresponding to low-pass frequencies, e.g. 0~1.5 kHz, and also may re-sample a sequence to correspond to R ($L_i/L_k$) times of an initial sample rate as shown in equation 2. Such interpolation may reduce a drop in resolution due to narrower sample intervals, and also improve frequency resolution.

In a next operation S204, the NLCG calculation unit 104 calculates a normalized local center of gravity (NLCG) on the spectrum of transformed and interpolated voice signals. This is shown in Equation 3.

$$cA(f_i) = \frac{1}{U}\frac{\sum_{j=1}^{j=U} iA(f_{i-U/2+j})}{\sum_{j=1}^{j=U} A(f_{i-U/2+j})} - 0.5 \quad \text{[Equation 3]}$$

Here, a symbol U represents a local region. The waveform of the calculated NLCG is similar in shape to the waveform in time region. Moreover, the periodic structure of harmonics may be effectively preserved.

In a next operation S205, the cumulated sum calculation unit 105 calculates a cumulated sum of the calculated NLCG.

In a next operation S206, the scale conversion unit 106 performs a scale conversion and interpolation on the cumulated sum. Here, the scale conversion unit 106 may convert a linear frequency scale into a logarithmic frequency scale.

In a next operation S207, the SHR calculation unit 107 calculates an SHR from a spectrum based on the cumulated sum. Here, the SHR may be advantageously calculated from the spectrum depending upon the cumulated sum on which the scale conversion and interpolation have been performed. The SHR may be calculated as shown in Equations 4 to 6.

$$SH = \sum_{n=1}^{N} A(nf_0) \quad \text{[Equation 4]}$$

Here, A(f): is a spectrum amplitude.

$$SS = \sum A((n-1/2)f_0) \quad \text{[Equation 5]}$$

$$SHR = \frac{SS}{SH} \quad \text{[Equation 6]}$$

In a next operation S208, the spectral auto-correlation calculation unit 108 calculates a spectral auto-correlation by using the calculated NLCG. This is shown in Equation 7.

$$sa(f_\tau) = \sum_i cA(f_i) \cdot cA(f_{i-\tau}) \quad \text{[Equation 7]}$$

Here, the spectral auto-correlation calculation unit 108 does not separately perform normalization. The reason is that normalization has already been performed in the above-discussed NLCG calculation step.

In a next operation S209, the voicing region determination unit 109 determines a voicing region based on the calculated spectral auto-correlation. Here, the voicing region determination unit 109 compares a maximum spectral auto-correlation with a predetermined value as shown in equation 8 below. Then a region in which the maximum spectral auto-correlation is greater than the critical value is determines as a voicing region.

$$\text{voiced if } \max\{sa(f_\tau)\} > T_{sa}$$

$$\text{unvoiced if } \max\{sa(f_\tau)\} < T_{sa} \quad \text{[Equation 8]}$$

In a next operation S210, the pitch extraction unit 110 extracts a pitch based on an SHR corresponding to the voicing region as shown in equation 9 below. Here, the pitch extraction unit 110 may obtain the pitch from a position of a local peak corresponding to a maximum SHR among SHRs corresponding to the voicing region.

$$P = \max_f\{SHR(f)\} \text{ if voiced} \quad \text{[Equation 9]}$$

As discussed above, the present embodiment provides a pitch detection method and an apparatus utilizing the method, which can extract a pitch in input voice signals after obtaining an SHR from a spectrum created by using an NLCG on the spectrum and its cumulated sum. Furthermore, the method and the apparatus of the present invention may obtain a spectral auto-correlation by using the NLCG and interpolation of the spectrum and thereby separate voiced and unvoiced sounds. The method and the apparatus may also use the separation of voiced/unvoiced sounds when extracting pitch by means of an SHR.

FIGS. 3A-3D illustrate a waveform of an original spectrum, a waveform of an interpolated spectrum, a waveform calculated by an NLCG, and a waveform calculated by a cumulated sum of the NLCG, respectively.

As discussed above, a typical method for detecting a pitch by using an SHR may be weak against a low pitch, such as in a man's voice, and is influenced by a spectral tilt due to a narrow interval between harmonic components in a spectrum. The waveforms shown in FIGS. 3A-3D, calculated by a cumulated sum of an NLCG derived from the present invention, may confirm that the above unfavorable problems of a conventional method are solved.

Figure 4:
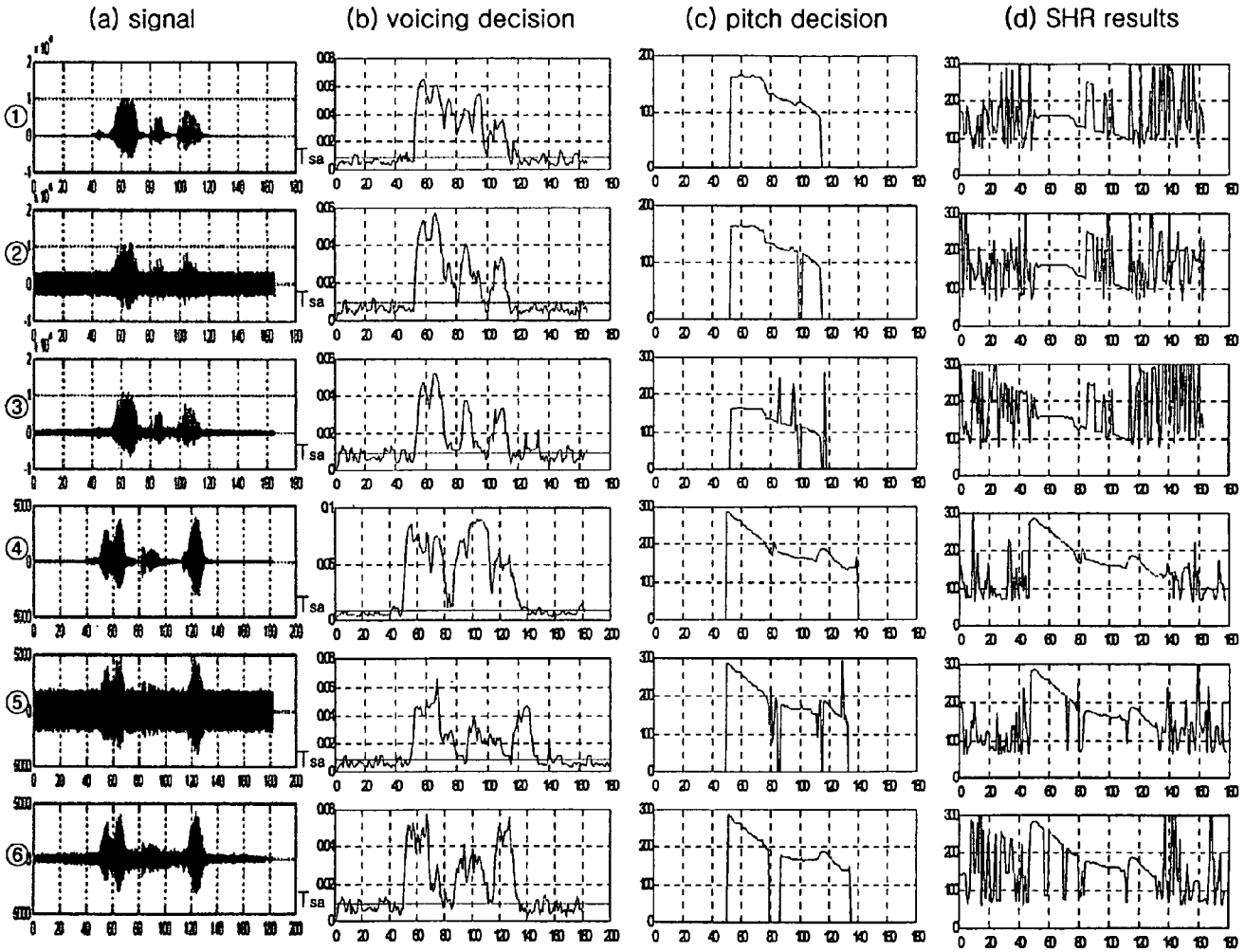
FIG. 4, parts (a)-(d), illustrates resultant waveforms obtained from experiments utilizing the pitch detection method according to an exemplary embodiment of the present invention.

FIG. 4, parts (a)-(d), illustrates resultant waveforms obtained from experiments utilizing the pitch detection method according to an exemplary embodiment of the present invention.

In part (a) of FIG. 4, input signals are shown. Specifically, 1 is a man's voice signal, 2 is a mixed signal of the man's voice and a white noise, and 3 is a mixed signal of the man's voice and an airplane noise. Also, 4 is a woman's voice signal, 5 is a mixed signal of the woman's voice and a white noise, and 6 is a mixed signal of the woman's voice and an airplane noise.

Furthermore, parts (b), (c) and (d) of FIG. 4 illustrate waveforms after the respective input signals are processed by the above-described method shown in FIG. 2. Specifically, part (b) shows voicing determination by using both a calculated spectral auto-correlation and a predetermined value $T_{sa}$, part (c) shows pitch determination, and part (d) shows results of using an SHR.

From 1 to 6 of part (d) of FIG. 4 may confirm that the present embodiment solves a problem that a typical method is weak against a low pitch, such as in a man's voice, due to a narrow interval between harmonic components in a spectrum.

The pitch detection method according to the above-described embodiments of the present invention may be embodied as a program instruction capable of being executed via various computer units and may be recorded in a computer readable recording medium. The computer readable medium may include a program instruction, a data file, and a data structure, separately or cooperatively. The program instructions and the media may be those specially designed and constructed for the purposes of the present invention, or they may be of the kind well known and available to those skilled in the art of computer software arts. Examples of the computer readable media include magnetic media (e.g., hard disks, floppy disks, and magnetic tapes), optical media (e.g., CD-ROMs or DVD), magneto-optical media (e.g., optical disks), and hardware devices (e.g., ROMs, RAMs, or flash memories, etc.) that are specially configured to store and perform program instructions. Examples of the program instructions include both machine code, such as produced by a compiler, and files containing high-level languages codes that may be executed by the computer using an interpreter. The hardware elements above may be configured to act as one or more software modules for implementing the operations of this invention.

According to the above-described embodiments of the present invention, provided are a pitch detection method and an apparatus utilizing the method, which may create a robust spectrum by using a normalized local center of gravity (NLCG) on the spectrum and its cumulated sum, and then may extract a pitch from input voice signals by using a sub-harmonic-to-harmonic ratio (SHR) obtained from the created spectrum.

According to the above-described embodiments of the present invention, provided are a pitch detection method and an apparatus utilizing the method, which may separate voiced and unvoiced sounds by obtaining a spectral auto-correlation by using an NLCG and interpolation of a spectrum, and then may use the separation of voiced/unvoiced sounds when extracting a pitch by using an SHR.

The pitch detection method and apparatus of the above-described embodiments of the present invention may cope effectively with halving and doubling issues of a pitch and may be relatively resilient against a noise since the pitch detection method and apparatus determine the pitch from a harmonic component and do not employ unnecessary information. The method and apparatus may further solve unfavorable problems that a typical method is weak against a low pitch, such as in a man's voice, and is influenced by spectral tilt due to a narrow interval between harmonic components in a spectrum.

Although a few embodiments of the present invention have been shown and described, the present invention is not limited to the described embodiments. Instead, it would be appreciated by those skilled in the art that changes may be made to these embodiments without departing from the principles and spirit of the invention, the scope of which is defined by the claims and their equivalents.

What is claimed is:

1. A method of detecting a pitch in input voice signals, the method comprising:

performing a Fourier transform on the input voice signals after performing a pre-processing on the input voice signals;

performing an interpolation on the transformed voice signals;

calculating a normalized local center of gravity (NLCG) on a spectrum of the interpolated voice signals;

calculating a spectral auto-correlation using the calculated NLCG;

determining a voicing region based on the calculated spectral auto-correlation;

calculating a cumulated sum of the calculated NLCG;

calculating a subharmonic-to-harmonic ratio (SHR) from the spectrum based on the calculated cumulated sum; and extracting a pitch, using a processor, based on the calculated SHR corresponding to the voicing region, wherein the NLCG is calculated by the equation below, $$\cdot cA(f_i) = \frac{1}{U}\frac{\sum_{j=1}^{j=U} iA(f_{i-U/2+j})}{\sum_{j=1}^{j=U} A(f_{i-U/2+j})} - 0.5$$

with U being a local region and A(f) being a spectrum amplitude.

2. The method of claim 1, wherein the performing of an interpolation includes:

performing a low-pass interpolation with regard to amplitudes corresponding to low-pass frequencies of the transformed voice signals; and re-sampling a sequence to correspond to R times of an initial sample rate.

3. The method of claim 1, wherein the pitch is obtained from a position of a local peak corresponding to a maximum SHR among SHRs corresponding to the voicing region.

4. The method of claim 1, wherein the determining of a voicing region includes determining the voicing region by means of a frequency component of the calculated spectral auto-correlation.

5. The method of claim 1, wherein the determining of a voicing region includes:

comparing a maximum of the calculated spectral auto-correlation with a predetermined value; and determining, as the voicing region, a region in which the maximum calculated spectral auto-correlation is greater than the predetermined value.

6. The method of claim 1, further comprising performing a scale conversion and interpolation on the cumulated sum, wherein the calculating an SHR includes calculating the SHR from the spectrum depending on the cumulated sum on which the scale conversion and interpolation have been performed.

7. The method of claim 6, wherein the performing a scale conversion comprises converting a linear frequency scale into a logarithmic frequency scale.

8. A non-transitory computer readable medium in which a program for executing a method of detecting a pitch in input voice signals is recorded, the method comprising:

performing a Fourier transform on the input voice signals after performing a pre-processing on the input voice signals;

performing an interpolation on the transformed voice signals;

calculating a normalized local center of gravity (NLCG) on a spectrum of the interpolated voice signals;

calculating a spectral auto-correlation using the calculated NLCG;

determining a voicing region based on the calculated spectral auto-correlation;

calculating a cumulated sum of the calculated NLCG;

calculating a subharmonic-to-harmonic ration (SHR) from the spectrum based on the calculated cumulated sum; and extracting a pitch based on the calculated SHR corresponding to the voicing region, wherein the NLCG is calculated by the equation below, $$\cdot cA(f_i) = \frac{1}{U}\frac{\sum_{j=1}^{j=U} iA(f_{i-U/2+j})}{\sum_{j=1}^{j=U} A(f_{i-U/2+j})} - 0.5$$

with U being a local region and A(f) being a spectrum amplitude.

9. An apparatus for detecting pitch in input voice signals, the apparatus comprising:

a pre-processing unit performing a predetermined pre-processing on the input voice signals;

a Fourier transform unit performing a Fourier transform on the pre-processed voice signals;

an interpolation unit performing an interpolation on the transformed voice signals;

a normalized local center of gravity (NLCG) unit calculating an NLCG on a spectrum of the interpolated voice signals;

a spectral auto-correlation calculation unit calculating a spectral auto-correlation using the calculated NLCG; and a voicing region determination unit determining a voicing region based on the calculated spectral auto-correlation a cumulated sum calculation unit calculating a cumulated sum of the calculated NLCG;

a subharmonic-to-harmonic ratio (SHR) calculation unit calculating an SHR from the spectrum based on the calculated cumulated sum; and a pitch extraction unit extracting a pitch based on the calculated SHR corresponding to the voicing region, wherein the NLCG is calculated by the equation below, $$\cdot cA(f_i) = \frac{1}{U}\frac{\sum_{j=1}^{j=U} iA(f_{i-U/2+j})}{\sum_{j=1}^{j=U} A(f_{i-U/2+j})} - 0.5$$

with U being a local region and A(f) being a spectrum amplitude.

10. The apparatus of claim 9, wherein the pitch is obtained from a position of a local peak corresponding to a maximum SHR among SHRs corresponding to the voicing region.

11. The apparatus of claim 9, wherein the voicing region determination unit compares a maximum of the calculated spectral auto-correlation with a predetermined value, and determines, as the voicing region, a region in which the maximum spectral auto-correlation is greater than the predetermined value.

12. The apparatus of claim 9, further comprising a scale conversion unit performing a scale conversion and interpolation on the cumulated sum, wherein the SHR calculation unit calculates the SHR from a spectrum depending on the cumulated sum on which the scale conversion and interpolation have been performed.

13. The apparatus of claim 12, wherein the scale conversion unit converts a linear frequency scale into a logarithmic frequency scale.

* * * * *

UNITED STATES PATENT AND TRADEMARK OFFICE

CERTIFICATE OF CORRECTION

PATENT NO. : 8,311,811 B2
APPLICATION NO. : 11/604276
DATED : November 13, 2012
INVENTOR(S) : Kwang Cheol Oh et al.

It is certified that error appears in the above-identified patent and that said Letters Patent is hereby corrected as shown below:

In the Claims:

Column 8; Line 25; In Claim 8, delete "ration" and insert -- ratio --, therefor.

Signed and Sealed this
Seventh Day of May, 2013

Teresa Stanek Rea
*Acting Director of the United States Patent and Trademark Office*